US010605006B2

(12) United States Patent
Finnman

(10) Patent No.: US 10,605,006 B2
(45) Date of Patent: Mar. 31, 2020

(54) SEMI-SEALED ROTARY DRILL TOOL

(71) Applicant: SANDVIK INTELLECTUAL PROPERTY AB, Sandviken (SE)

(72) Inventor: Karl-Oskar Finnman, Sandviken (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/506,833

(22) PCT Filed: Aug. 24, 2015

(86) PCT No.: PCT/EP2015/069314
§ 371 (c)(1),
(2) Date: Feb. 27, 2017

(87) PCT Pub. No.: WO2016/030309
PCT Pub. Date: Mar. 3, 2016

(65) Prior Publication Data

US 2017/0254151 A1 Sep. 7, 2017

(30) Foreign Application Priority Data

Aug. 28, 2014 (EP) ..... 14182604

(51) Int. Cl.

| | |
|---|---|
| ***E21B 10/18*** | (2006.01) |
| ***E21B 10/23*** | (2006.01) |
| ***E21B 10/24*** | (2006.01) |
| ***E21B 10/22*** | (2006.01) |
| ***E21B 10/08*** | (2006.01) |

(52) U.S. Cl.
CPC ..... *E21B 10/23* (2013.01); *E21B 10/08* (2013.01); *E21B 10/18* (2013.01); *E21B 10/22* (2013.01); *E21B 10/24* (2013.01); *E21B 2010/225* (2013.01); *E21B 2010/243* (2013.01)

(58) Field of Classification Search
CPC ..... E21B 10/23; E21B 10/18; E21B 10/24; E21B 10/243; E21B 36/04; E21B 37/00
See application file for complete search history.

(56) References Cited

U.S. PATENT DOCUMENTS

| | | | | |
|---|---|---|---|---|
| 1,945,240 A | | 1/1934 | Tupica | |
| 2,207,188 A | | 7/1940 | Zublin | |
| 2,690,935 A | * | 10/1954 | Alexander | E21B 10/22 384/96 |
| 3,102,601 A | | 9/1963 | Worth | |

(Continued)

FOREIGN PATENT DOCUMENTS

| | | |
|---|---|---|
| CL | 45449 | 11/1996 |
| CL | 48115 | 1/2001 |

(Continued)

*Primary Examiner* — Giovanna C Wright
*Assistant Examiner* — Yanick A Akaragwe
(74) *Attorney, Agent, or Firm* — Corrine R. Gorski

(57) ABSTRACT

A rotary drill tool for cutting rock includes at least one journal leg mounting a spindle and a respective rotary cone cutter. The spindle includes a plurality of fluid distribution passageways arranged to provide a supply of a cooling and cleaning fluid to the bearing assembly. Vent holes are provided through the cutter to allow an exhaust flow of fluid and an annular seal is provided at a base region of the spindle to maintain a positive fluid pressure within the cutter cavity to prevent dust and dirt ingress.

13 Claims, 15 Drawing Sheets

(56) References Cited

U.S. PATENT DOCUMENTS

| | | | |
|---|---|---|---|
| 3,193,028 | A | 7/1965 | Ivan |
| 3,303,898 | A | 2/1967 | Cheorghe |
| 3,727,705 | A | 4/1973 | Newman |
| 3,921,735 | A | 11/1975 | Dysart |
| 4,193,463 | A | 3/1980 | Evans |
| 4,200,343 | A | 4/1980 | Highsmith |
| 4,421,184 | A | 12/1983 | Mullins |
| 4,688,651 | A | 8/1987 | Dysart |
| 7,392,862 | B2 | 1/2008 | Zahradnik et al. |
| 2012/0160561 | A1 | 6/2012 | Ramirez et al. |
| 2012/0193151 | A1 | 8/2012 | Harrington et al. |

FOREIGN PATENT DOCUMENTS

| | | |
|---|---|---|
| CL | 20170463 | 2/2017 |
| FR | 1295380 A | 6/1962 |

* cited by examiner

SEMI-SEALED ROTARY DRILL TOOL

RELATED APPLICATION DATA

This application is a § 371 National Stage Application of PCT International Application No. PCT/EP2015/069314 filed Aug. 24, 2015 claiming priority of EP Application No. 14182604.0, filed Aug. 28, 2014.

FIELD OF INVENTION

The present invention relates to a rotary drill tool and in particular, although not exclusively, to a drill tool configured to provide a fluid flow path for a cooling/cleaning fluid to flow through and exit the tool via a plurality of the vent holes within a rotatably mounted cutter.

BACKGROUND ART

Rotary drills have emerged as an effective tool for specific drilling operations such as the creation of blast holes and geothermal wells. The drill typically comprises a rotary drill bit having three journal legs that mount respective cone-shaped rolling cutters via bearing assemblies that include rollers and balls.

Typically, the drill bit is attached to one end of a drill string that is driven into the borehole via a rig. The cutting action is achieved by generating axial feed and rotational drive forces that are transmitted to the drill bit via the drill rods coupled end-to-end. Each of the cone-shaped cutters comprise externally mounted hardened cutting buttons positioned at different axial regions for optimised cutting as the drill bit rotates.

So as to cool the bearings, air is typically supplied down the drill string through the journal legs and into an internal cavity of each cutter within which the bearings are mounted. The air circulates around the bearings and is typically vented via the cavity mouth. Example rotating bits and cutters are described in U.S. Pat. Nos. 3,193,028; 3,921,735; 4,688,651, 4,421,184, 4,193,463 and U.S. 2012/0160561.

In particular, the air flow to the different regions of the bearing assemblies is achieved via air flow passageways formed within a spindle (commonly referred to as a journal) that mounts a respective cutter and bearings. Typically, the air circulates around the bearings and flows in a directional path of least resistance. Accordingly, differential cooling problems arise in existing cutting tools with certain bearing regions being inadequately cooled. As will be appreciated, insufficient air flow over the bearings leads to temperature rise due to friction and results in enhanced wear and a corresponding shortening of the operational lifetime of the bearings, the spindle and the cutter.

Additionally, it is known to employ vent holes through the cutter as described in U.S. Pat. No. 4,193,463 in an effort to cool the axially forwardmost bearings located at the apex of the spindle. However, such designs are susceptible to dirt infiltrating the cutter cavity and blocking the vent holes that results in insufficient cooling and accelerated frictional wear of the various components. Attempts have been made to prevent ingress via the use of grease. However, once the grease seal is broken dirt contamination is inevitable and the bearing lifetime is shortened. Accordingly, what is required is a drill tool that addresses the above problems.

SUMMARY OF THE INVENTION

It is an objective of the present invention to provide a rotary drill tool configured for optimised cooling of the bearing assemblies that mount each cone cutter whilst minimising the risk of dirt ingress into the region of the bearings. It is a further specific objective to provide a semi-sealed rotary drill bit having an optimised internal fluid flow passageway to deliver a cooling fluid to high friction regions of the bearing assemblies without permitting dust and debris surrounding the cutting tool to penetrate through to the bearing surfaces. It is a yet further specific objective to provide a rotary drill bit configured to create and direct an exhaust fluid flow from the cutter that is effective to clean the external cutting region of the tool and prevent the build-up of debris material that may otherwise reduce cutting performance.

The objectives are achieved via a combination of a fluid flow passageway network within each spindle that mounts each respective bearing assembly and a cone shaped cutter configured to control and direct the flow of the fluid to each region of the bearing assembly where frictional contact between the spindle, bearings and cone cutter would otherwise lead to high temperatures and accelerated wear. The objectives are further achieved by providing suitable vent holes through the body of each cutter such that the fluid flow path around the bearings is controlled and specifically directed to exit the tool at a plurality of predefined circumferentially and axially (relative to the cutter base and apex) spaced apart regions of the cutter. Such an arrangement is advantageous to ensure high load and friction bearing surfaces are cooled sufficiently and prevented from overheating and accelerated wear. The objectives are further achieved via a seal provided at a base region of each spindle and cutter that acts to create a positive fluid pressure within the region of the bearings housed between the cutter and the spindle. The seal is effective to prevent debris entering the bearing assembly and to at least inhibit the fluid exiting at the base region of the cutter and spindle such that the fluid flow is contained around the bearings and exits exclusively or predominantly through the vent holes of the cutter. The cross sectional area of the vent holes may be selected to create a positive fluid pressure within the cutter internal cavity (mounting the bearings) relative to the external pressure immediately surrounding the drill tool.

Advantageously, the distribution, configuration and relative positioning of the spindle internal passageways and cutter vent holes ensures that the fluid flow path through the tool is optimised and is delivered specifically to the high friction shoulder ('snoochie') region and the axially forwardmost pilot thrust surfaces. The vent holes and positive fluid pressure within the cavity of the cutter are beneficial as dust and debris surrounding the tool is both cleaned from the external cutting region and prevented from passage through the vent holes and into contact with the bearings. Similarly, this positive pressure is also effective to prevent the debris laden air from penetrating into the cutter cavity via the cavity mouth.

According to a first aspect of the present invention there is provided a rotary drill tool for cutting rock comprising: a main body having an internal fluid supply passageway; a spindle projecting from the main body and having at least one internal fluid distribution passageway in communication with the supply passageway and extending within the spindle to allow a fluid received from the supply passageway to flow through and exit the spindle; a cutter rotatably mounted on the spindle via bearings, the cutter having at least one vent hole to allow the fluid received from the distribution passageway to exit the tool; characterised by: an annular seal positioned between a base region of the spindle and the cutter to restrict fluid exiting the tool at the base region.

Preferably, the spindle comprises an annular shoulder and an end, the shoulder positioned axially between the base region and the end; wherein the distribution passageway is divided into at least two distribution passageways, a first distribution passageway exiting the spindle substantially at the shoulder and a second distribution passageway exiting the spindle substantially at the end. The shoulder region may be defined by one or more radially extending flanges that provide surfaces on which the bearings are mounted. The direction of the distribution passageways to exit at the shoulder and end (or apex region) of the spindle are advantageous to direct the flow of cooling/cleaning air to the high friction regions and to ensure all frictional contact regions of the assembly are cooled and cleaned.

Optionally, the first passageway is divided into two passageways exiting at different circumferential regions of the shoulder. Optionally, the shoulder is defined, in part, by an annular first bearing surface, the first passageway exiting the spindle at the first bearing surface. Two distribution passageways exiting at the spindle shoulder have be found to provide optimised cooling and cleaning of the snoochie region of the bearing.

Preferably, at least part of the first bearing surface is aligned substantially perpendicular to a longitudinal axis of the spindle. Such an arrangement is beneficial to provide the necessary axial support for the roller bearings.

Preferably, the end is defined, in part, by a second surface aligned substantially perpendicular to the axis of the spindle and the second distribution passageway exiting the spindle at the second surface. Providing a distribution passageway to the end or pilot thrust surfaces ensures the apex region of the bearing assembly, and in particular the pilot thrust plug surfaces, are sufficiently clean and cool.

Preferably, the bearings may comprise: a first set of roller bearings mounted at or towards the base region; a second set of roller bearings mounted at or towards an end of the spindle; and a set of ball bearings mounted axially between the first and second set of roller bearings; wherein the first passageway exits the spindle axially between the set of ball bearings and the second set of roller bearings. The rearward end of the second set of roller bearings are mounted at the high friction snoochie region. The present configuration is therefore advantageous to provide sufficient cleaning and cooling of the roller bearings and the respective bearing surfaces at the snoochie region.

Preferably, the cutter has an internal cavity to receive the spindle and the bearings, the cavity defined axially by: a base section to accommodate the first set of roller bearings; an intermediate section to accommodate the set of ball bearings and an end section to accommodate the second set of roller bearings; wherein at least one vent hole extends through the cutter at a position closest to the end section and at least one vent hole extends through the cutter at a position axially between the end and the intermediate sections. The provision and specific distribution of vent holes is advantageous to allow exhaust of the cooling/cleaning fluid at desired regions of the cutter whilst controlling the fluid flow within the cutter cavity. Such an arrangement is also effective to clean the forward, drive, cutting and gauge regions of the cutter to optimise cutting performance. Preferably, at least one vent hole extends through the cutter at a position closest to the base section. The axially rearward vent hole is effective to clean the drive and gauge regions of the cutter and to facilitate fluid flow at the base region of the spindle at and towards the base (larger) roller bearings.

Optionally, the tool may comprise three sets of vent holes, a first set positioned at or towards a base of the cutter, a third set positioned at or towards an apex of the cutter and a second set positioned axially between the first and third sets of vent holes. Preferably, and according to a specific implementation, the first set comprises one to four vent holes and the second and third sets each comprise respectively two to six vent holes. Optionally, the first set comprises one vent hole and the second and third sets each comprise respectively four vent holes.

Optionally, the cutter comprises an annular groove provided at an internal facing surface to at least partially accommodate the seal. According to further implementations, a neck region of the spindle may comprise an annular groove with the annular seal mounted within the groove of the spindle to sit against the internal facing surface that defines the cutter cavity. Mounting the seal at a groove within the cutter is advantageous to minimise wear of the seal, optionally formed as a rubber O-ring.

Preferably, the spindle comprises a cylindrical neck provided at a junction with the main body wherein the seal is positioned radially between the groove and a radially outer surface of the neck.

Optionally, a combined cross sectional area of the vent holes is substantially equal to or less than a cross sectional area of the supply passageway. Such an arrangement maintains a positive pressure within the cutter cavity so as to prevent dirt and dust ingress through the vent holes and/or internally beyond the seal.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
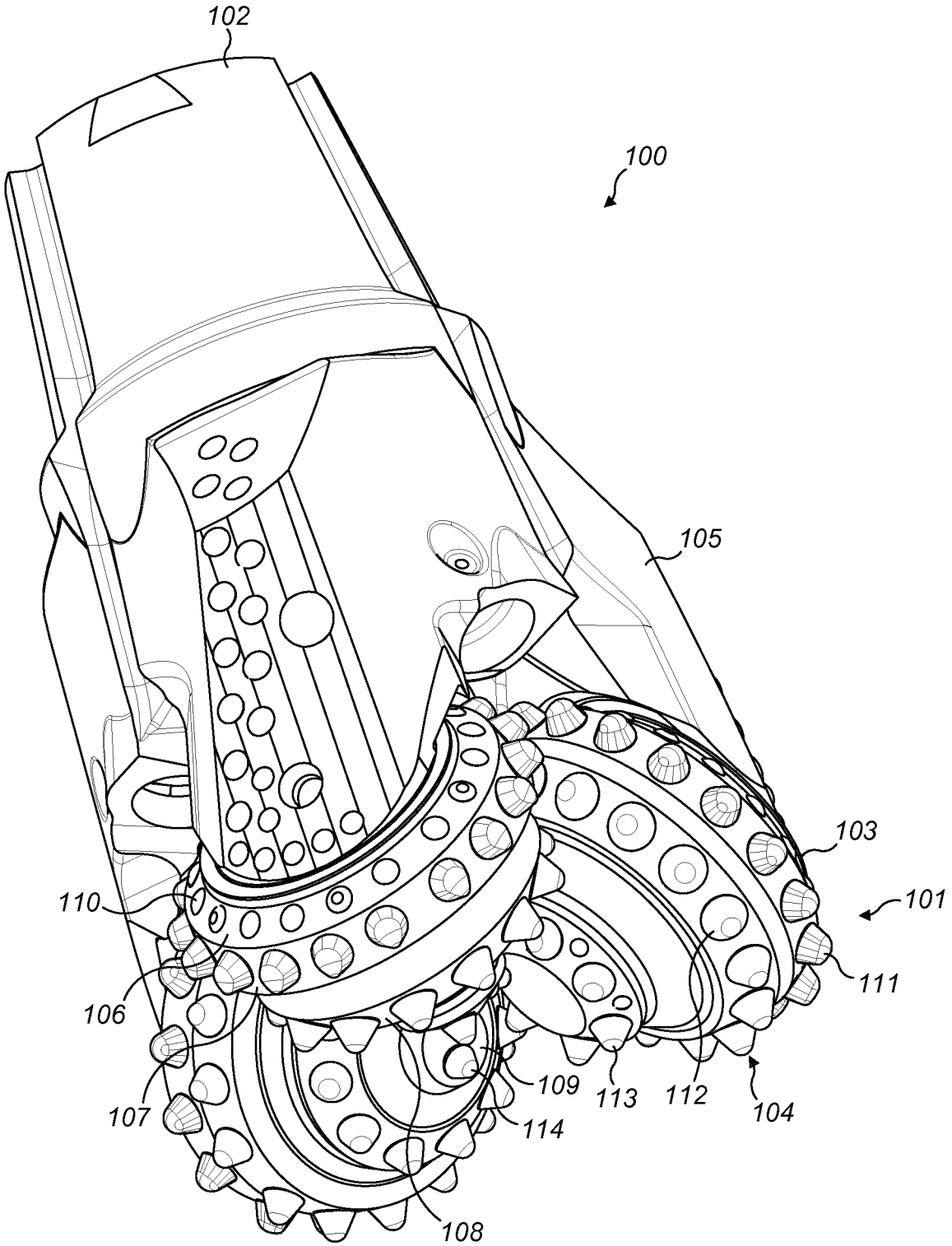
FIG. 1 is an external perspective view of a rotary cutting tool for mounting at one end of a drill string according to a specific implementation of the present invention.
Figure 2:
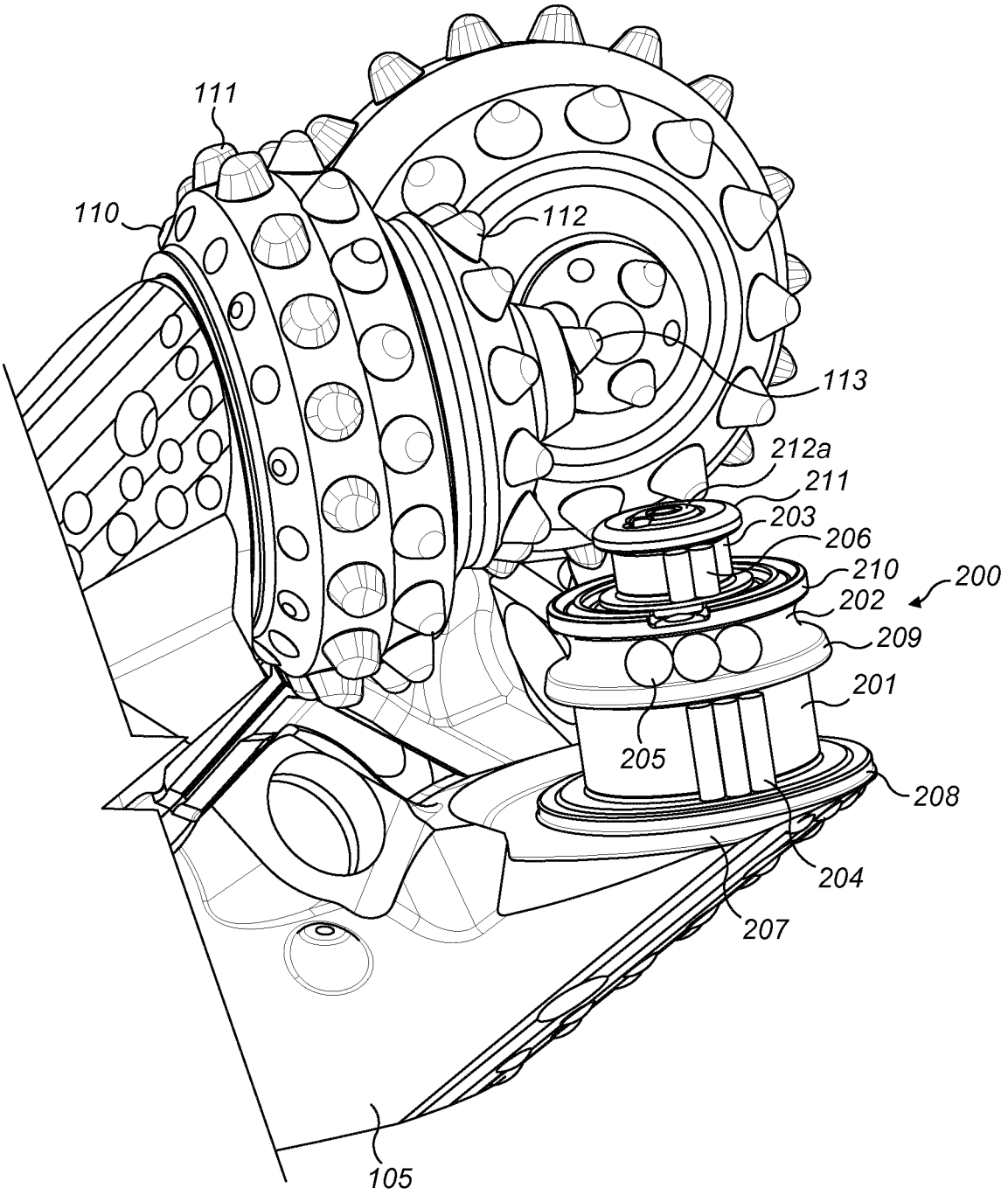
FIG. 2 is a further perspective view of the cutting end of the tool of FIG. 1 with one of the rotary cone cutters removed for illustrative purposes detailing a spindle that extends from one end of the journal leg.

Referring to FIG. 1, a rotary cutting tool 100 is formed as a cutting bit and comprises a cutting end 101 at an axially forward position and an axially rearward attachment end 102 configured for mounting at one end of a drill string (not shown) forming part of a drill assembly operated via a drilling rig (not shown) configured to provide axial and rotational drive of tool 100. Tool 100 comprises three journal legs 105 projecting axially forward from attachment end 102 and being aligned slightly radially outward such that cutting end 101 comprises a generally larger cross section than attachment end 102. A generally conical shaped cutter 103 is mounted at an end of each journal leg 105 so as to be capable of rotation relative to leg 105 and independent rotation about a separate axis relative to a general rotation of tool 100 and the drill string (not shown).

Referring to FIGS. 1 to 3B, a spindle 200 projects generally transverse from an axially forwardmost end 207 of each journal leg 105 and comprises a central longitudinal axis 307. Spindle 200 may be considered to be divided into three axial sections. A generally cylindrical base section or annular base raceway 201 is defined axially between an annular base flange 208 mounted at journal leg end 207 and a first intermediate radially projecting flange 209. An intermediate annular section or bearing raceway 202 extends axially beyond base raceway 201 and is defined axially between first intermediate flange 209 and an intermediate second radially projecting flange 210 that represent a shoulder region of spindle 200. Raceway 202 comprises a generally concave external surface. A third generally cylindrical annular section or bearing raceway 203 projects axially from intermediate section 202 and is defined between second annular flange 210 and an annular end flange 211. An apex region of the spindle 200 is defined by an annular thrust or end surface 308 provided at section 203. Additionally, a recess 300 extends axially within section 203 from thrust surface 308 and mounts a short cylindrical thrust plug 212*a*. Section 203 represents a nose or pilot region of spindle 200. A first set of base roller bearings 204 are mounted at base raceway 201 and extend axially between flanges 208 and 209. A second or end set of roller bearings 206 extend axially between flanges 210, 211 being mounted at end raceway 203. Additionally, a set of ball bearings 205 are positioned axially intermediate roller bearings 204, 206 and are mounted at intermediate raceway 202.

Each cone cutter 103 comprises a generally cone or dome shaped configuration. In particular, and referring to FIG. 6 and FIG. 1, each cutter 103 comprises a radially external facing surface 617 and a radially internal facing surface 616 that defines an internal cavity indicated generally by reference 600. Referring to FIG. 1, in an axial direction cone cutter 103 may be divided into axial sections at outer surface 617 and comprises a heel row 106, a gauge row 107, a drive row 108 and an inner or apex region 109. A plurality of sets of cutting buttons indicated generally by reference 104 are provided at each respective axial section including in particular heel buttons 110, gauge buttons 111, drive buttons 112 and inner buttons 113, 114. Each cutting button 104 is formed from a wear resistant cemented carbide based material and may comprise any known configuration including semi-spherical, conical, ballistic, semi-ballistic or chisel shaped.

Figure 3A:
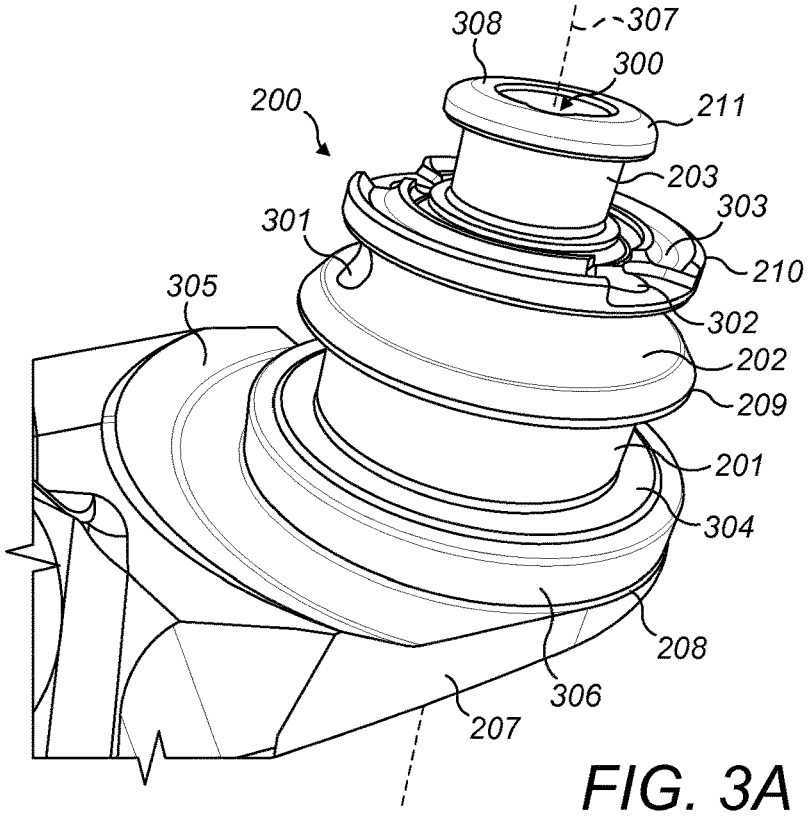
FIGS. 3A and 3B are further external perspective views of the spindle and journal leg of FIG. 2.
Figure 3B:
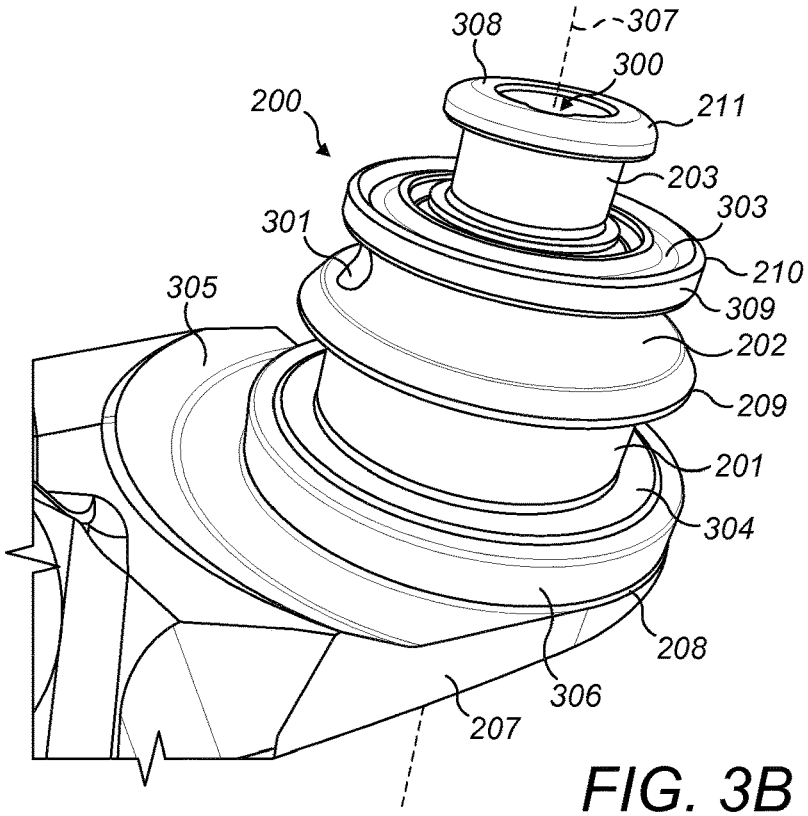
Figure 4:
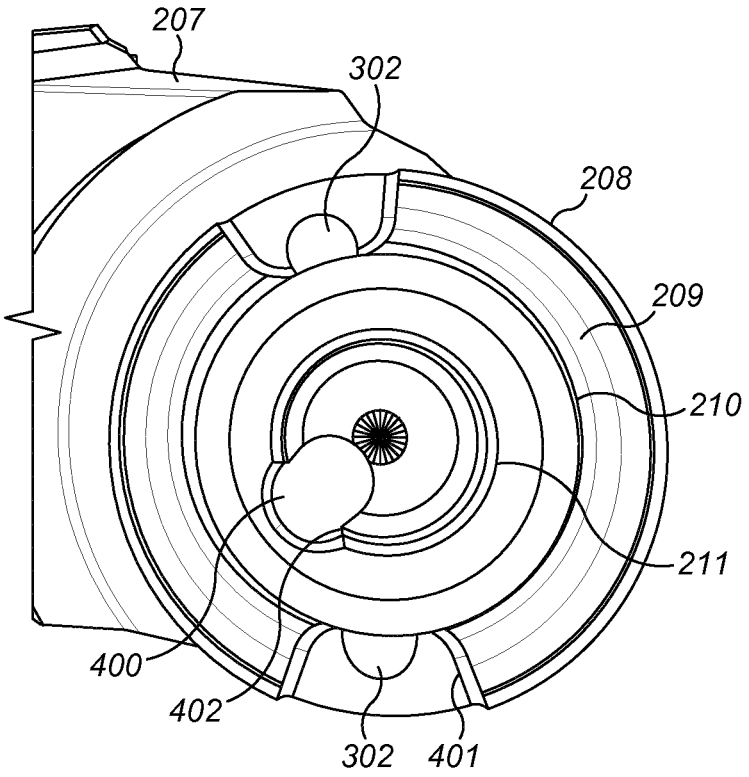
FIG. 4 is a plan view of the spindle of FIG. 2.
Figure 5:
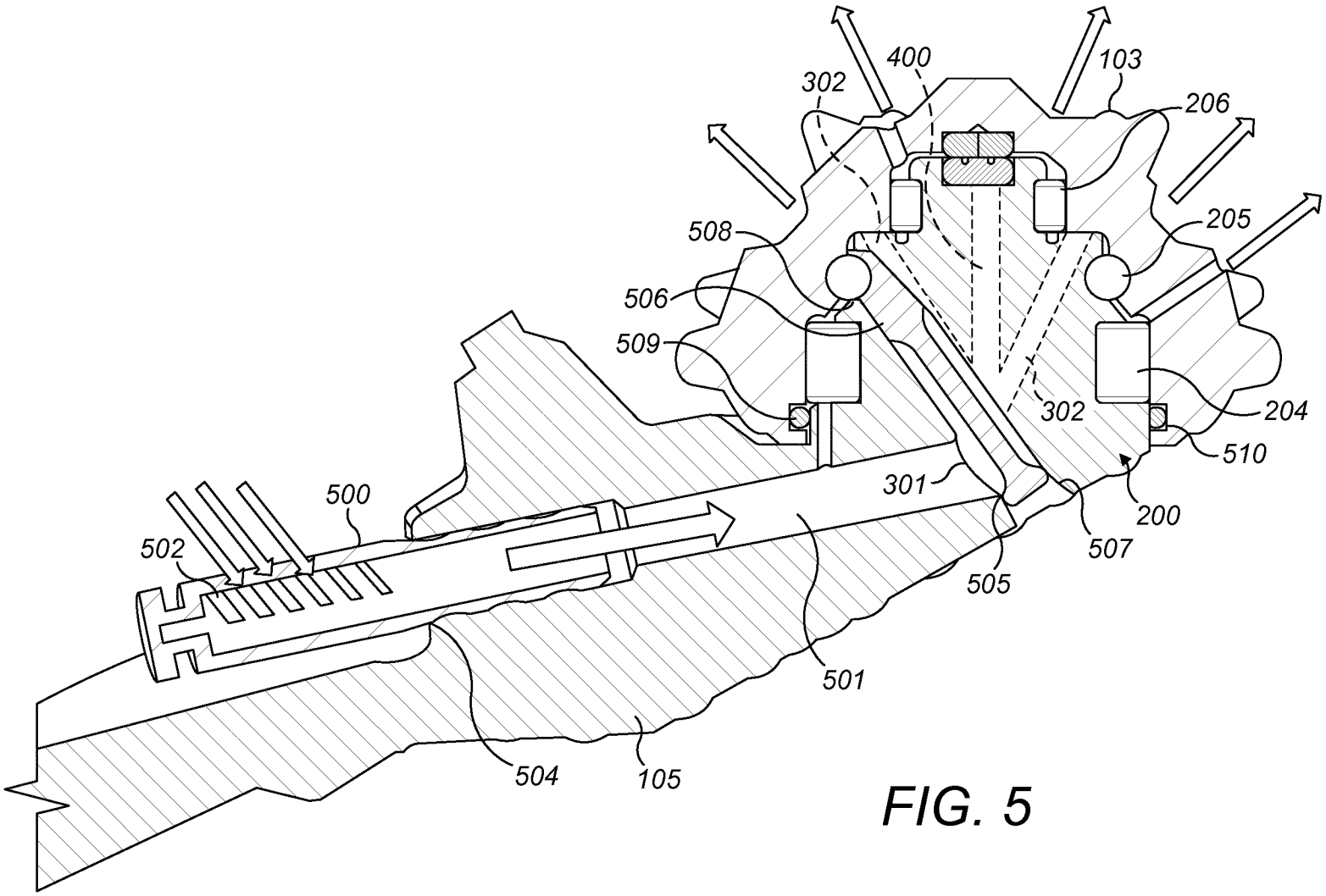
FIG. 5 is a cross sectional view through one of the cone cutters, spindle and journal legs of FIG. 1.
Figure 10:
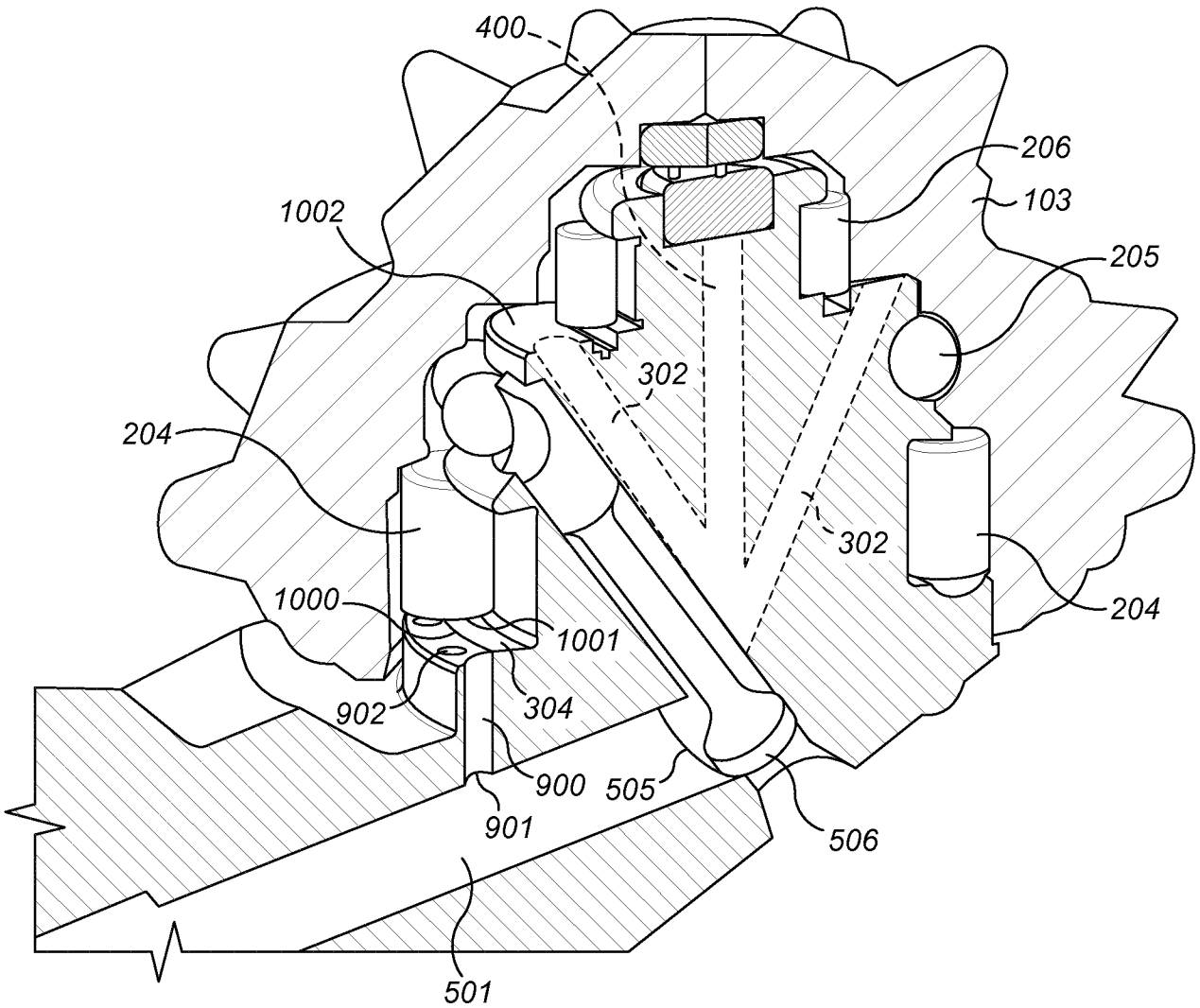
FIG. 10 is a further cross sectional perspective view of the cone cutter, spindle and journal leg of FIG. 1.
Figure 11:
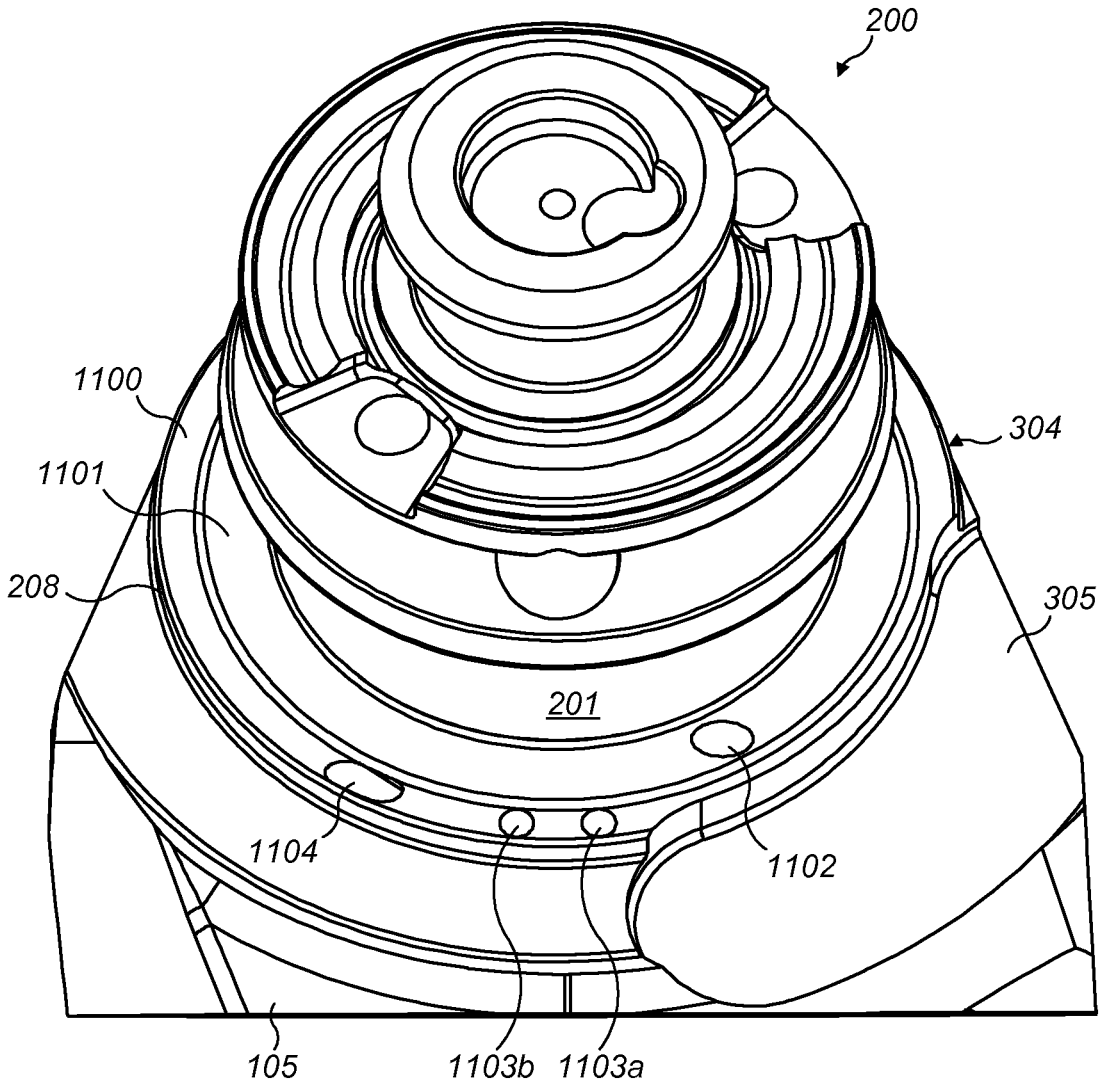
FIG. 11 is an external perspective view of the spindle and journal leg of FIG. 1 illustrating four by-pass passageways according to a specific implementation.
Figure 12:
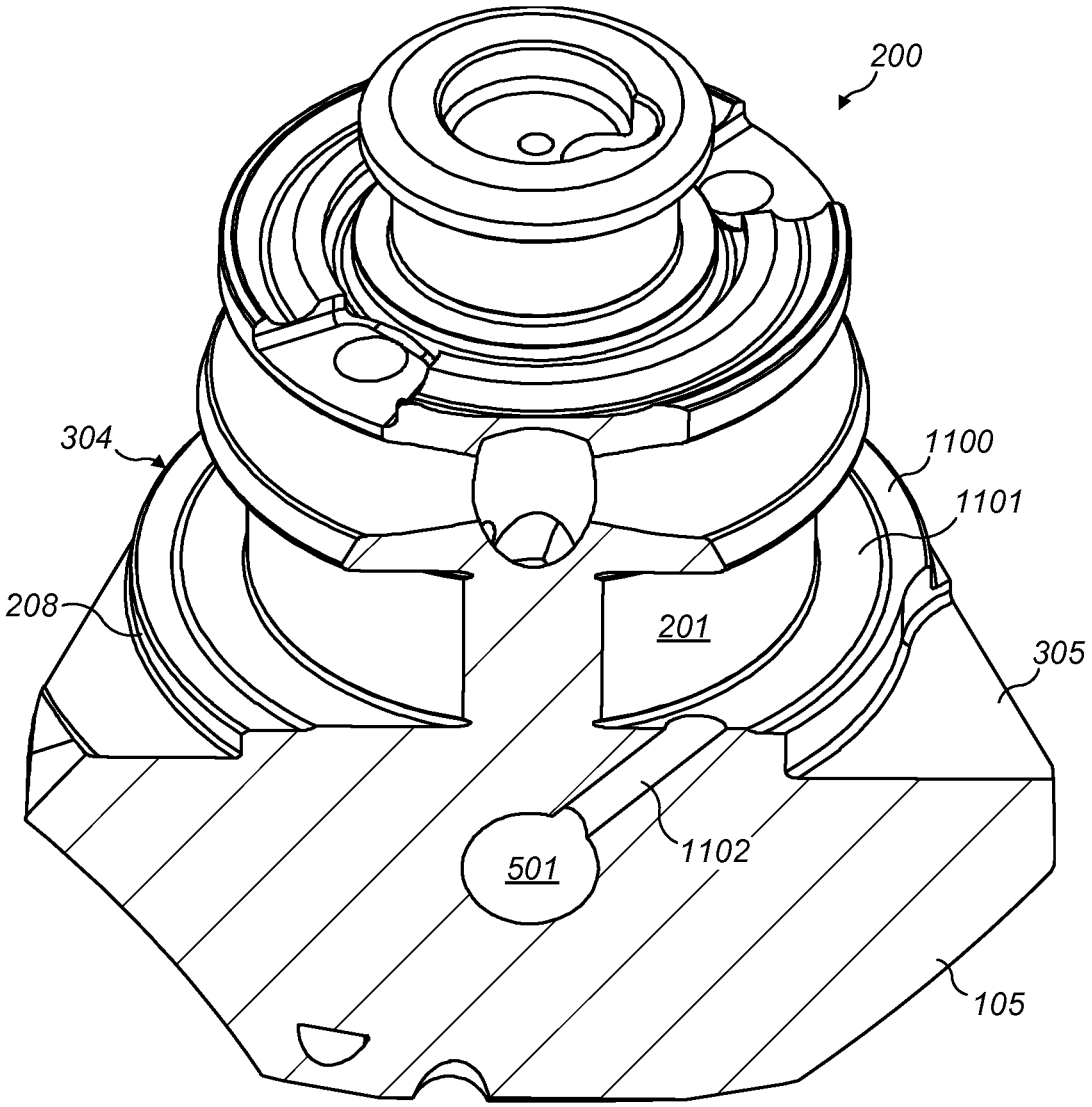
FIG. 12 is a cross sectional perspective view of the spindle and journal leg of FIG. 1 illustrating a first by-pass passageway according to a specific implementation.
Figure 13:
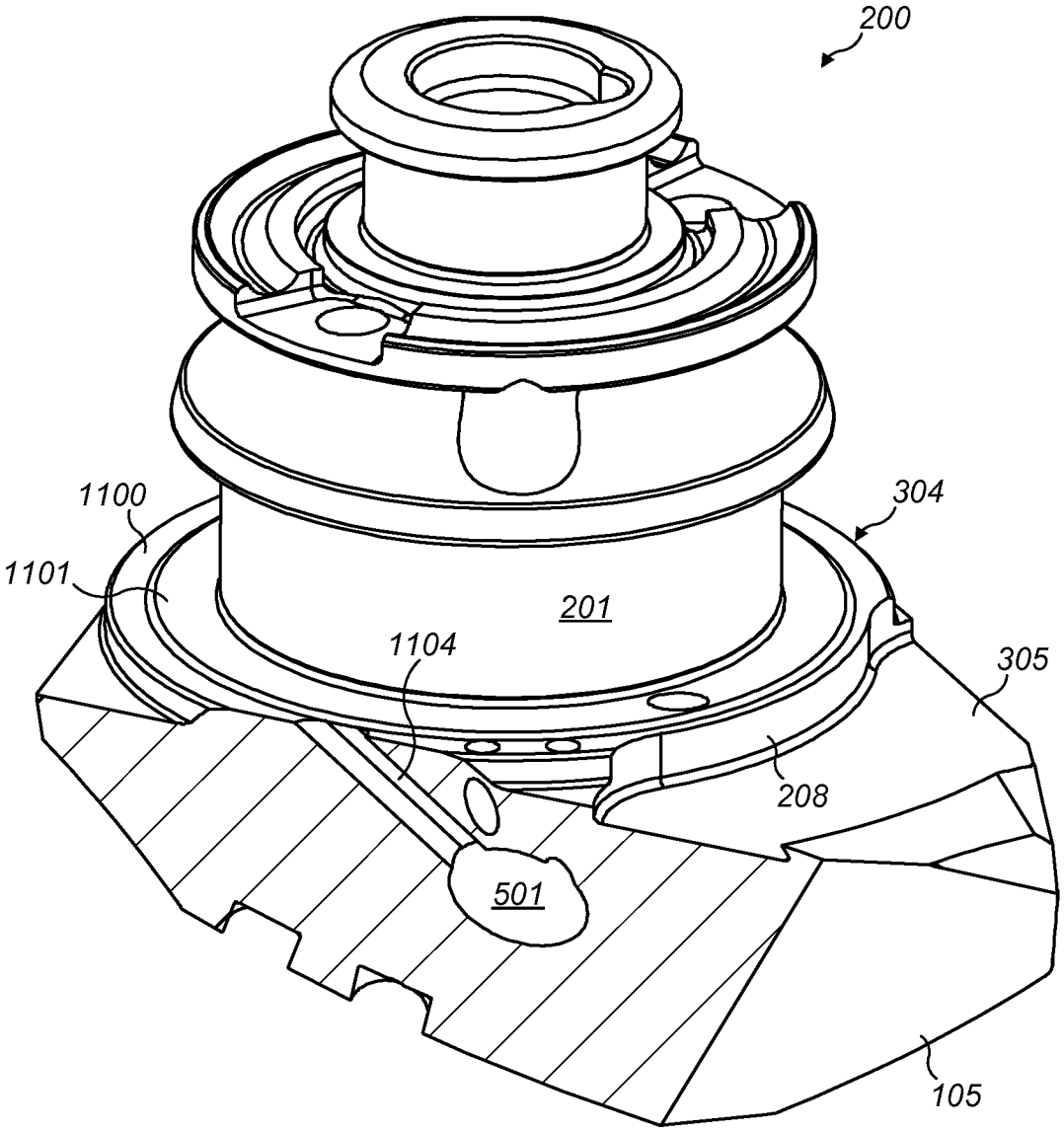
FIG. 13 is a further cross sectional perspective view of the spindle and journal leg of FIG. 1 illustrating a second by-pass passageway according to a specific implementation.
Figure 14:
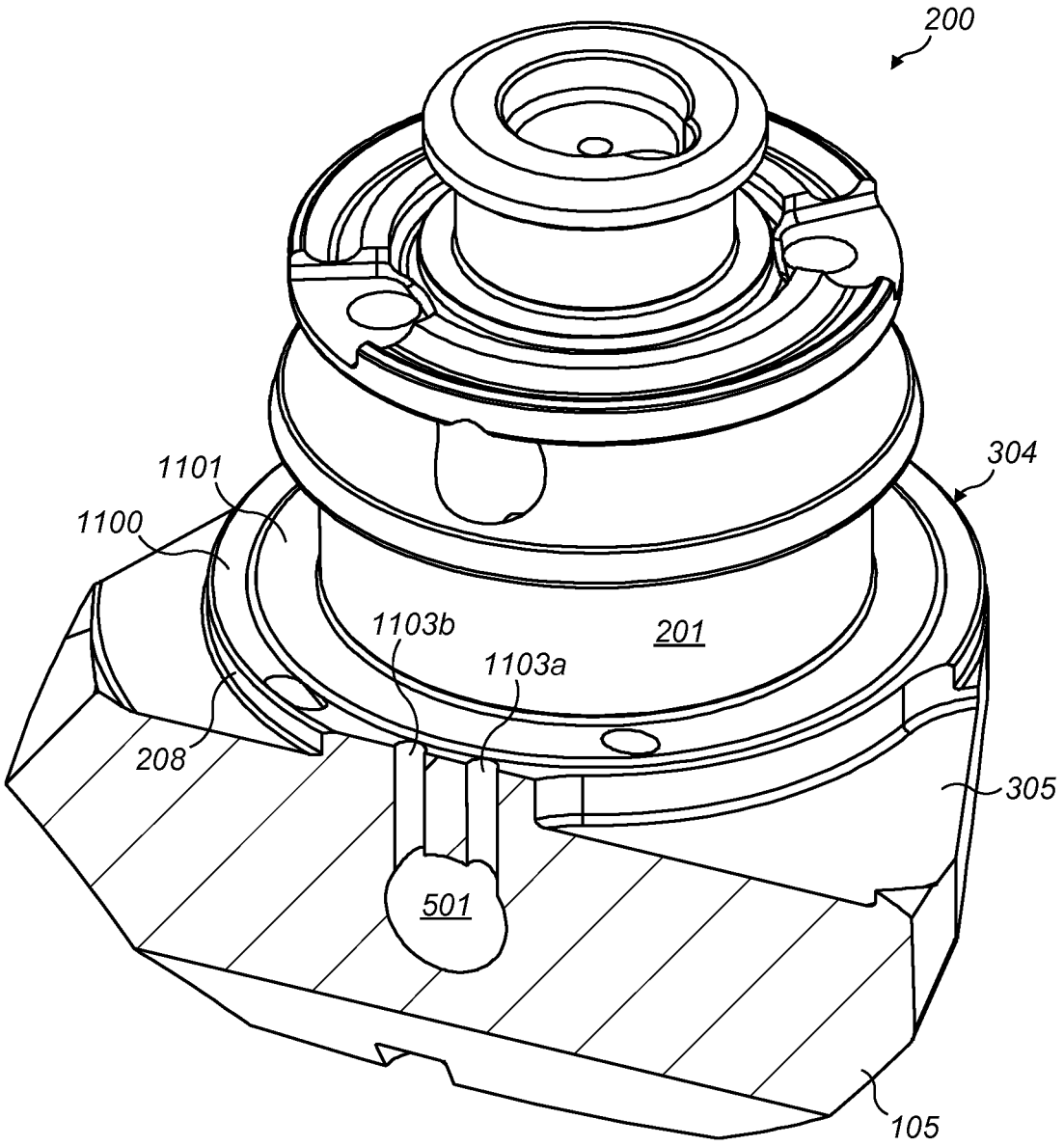
FIG. 14 is a further cross sectional perspective view of the spindle and journal leg of FIG. 1 illustrating a third and fourth by-pass passageway according to a specific implementation.

Referring to FIGS. 3A to 4, spindle 200 comprises a bearing support surface 304 facing axially forward at base flange 208 to support larger roller bearings 204 and a second axially forward facing surface (commonly referred to as a 'snoochie' face) provided at second intermediate flange 210. The annular snoochie face is formed by an annular groove 303 (at flange 210) that is filled with a carbide based wear resistant material so as to form a substantially planar annular thrust surface 1002 (illustrated in FIG. 10) to bear against and transmit the axial loading forces from cutter 103. The radially inner region of the snoochie face also provides support to mount the smaller roller bearings 203.

The axial load during cutting is also transmitted from cutter 103 to spindle 200 via i) the thrust plug 212*a* that bears against a cooperating thrust plug 212*b* mounted within an internal cavity of cutter 103 and ii) abutment contact between thrust surface 1002 and a corresponding surface 620 within the internal cavity of cutter 103. Bearings 204, 206 are configured to take the radial loads imparted by cutter 103 whilst bearings 205 lock cutter 103 in position about spindle 200 so as to be rotatably mounted at journal leg end 207.

Referring to FIGS. 3A to 5, spindle 200 and journal leg 105 comprise respective internal passageways configured to deliver air received from the drill rig and drill string (not shown) to the cutting region of tool 100. The air provides both cleaning of cuttings within the drill hole around the cutters 103 and also serves to cool the bearings 204, 205, 206 and the respective thrust surfaces. In particular, journal leg 105 comprises a supply passageway 501 extending generally in a direction from rearward end 102 to leg end 207. An air tube 500 is attached to a rearward end 504 of supply passageway 501 and comprises a plurality of air inlets 502 through which the air is channelled when received from the main body of tool 100. A terminal end 505 of supply passageway 501 is provided in fluid communication with a ball (or directing) passageway 301 being dimensioned to allow introduction of ball bearings 205 into position at raceway 202 when cutter 103 is mounted at spindle 200. Ball passageway 301 comprises a first end 507 being open at a rearward base region of spindle 200 and a second end 508 that emerges at ball bearing raceway 202. A ball plug 506 is releasably mounted within ball passageway 301 so as to retain bearings 205 in position at raceway 202. A weld or similar material (not shown) may be provided at passageway end 507 so as to secure plug 506 in position. A plurality of airflow distribution passageways extend from ball passageway 301 and are provided in fluid communication with supply passageway 501. In particular, two passageways 302 extend from ball passageway 301 to emerge at the snoochie face 1002 and a further distribution or pilot passageway 400 extends from ball passageway 301 to emerge at nose flange 211 adjacent thrust plug 212*a*. Each passageway 302 emerges at a recessed section 401 indented into annular grooved surface 303. Additionally, passageway 400 also emerges at a recessed section 402 of the pilot or thrust flange 211. Accordingly, air is configured to flow internally through each journal leg 105 and spindle 200 so as to be delivered to the friction bearing snoochie surface 1002 and the contact surfaces between thrust plugs 212*a*, 212*b* in addition to cooling the ball 205 and roller 204, 206 bearings.

The present tool 100 may be implemented as an open or semi-sealed tri-cutter assembly. According to the present semi-sealed implementation, the internal volume defined between the cone internal surface 616 and spindle 200 is at least partially sealed by a sealing gasket provided at a base region of spindle and cutter 103. In particular, an annular groove 510 is recessed into cutter internal cavity 600 and is dimensioned to accommodate a rubber O-ring 509 that partially projects radially into cavity 600 from annular groove 510. O-ring 509 is positioned to sit against an annular surface 306 provided at base flange 208 such that a seal is created between surface 306 and cone internal surface 616.

Figure 6:
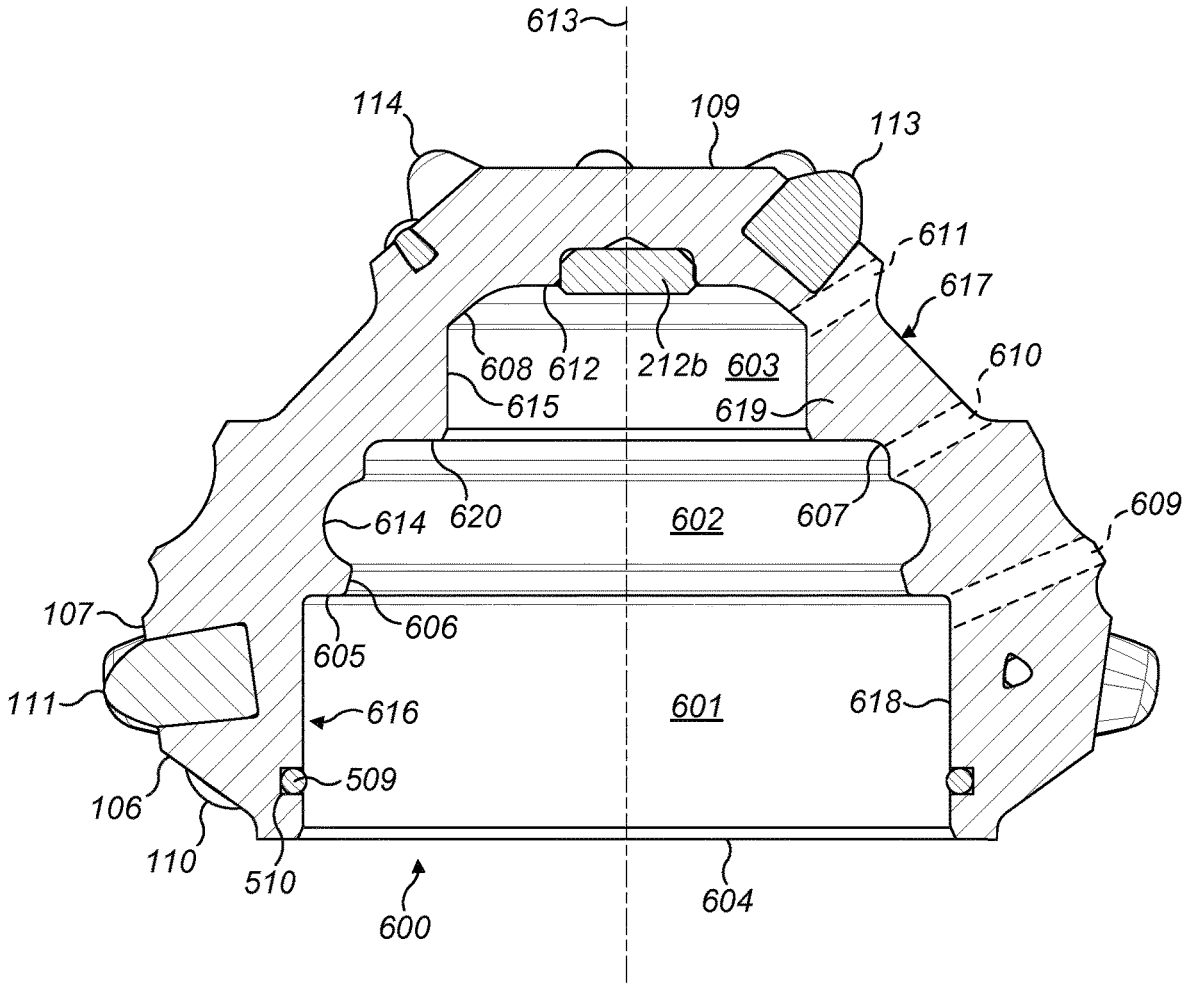
FIG. 6 is a cross section through one of the cone cutters of FIG. 1.
Figure 7:
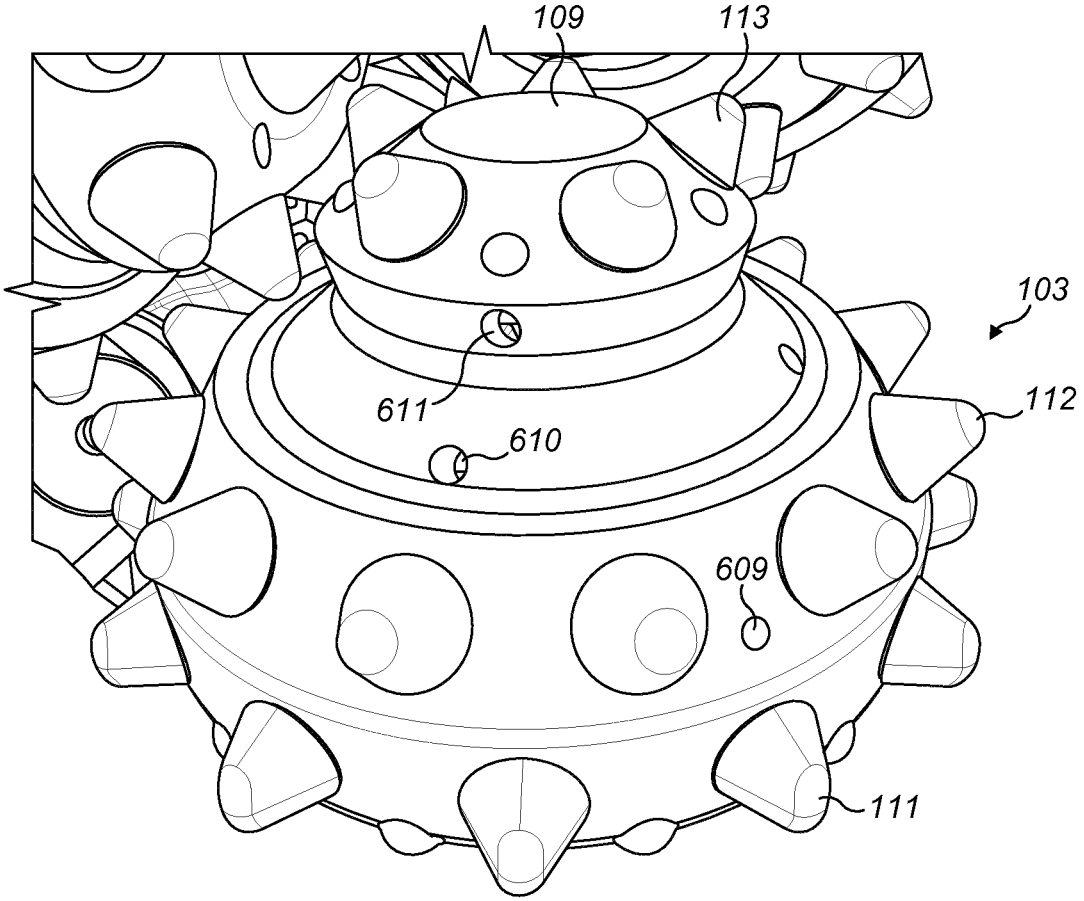
FIG. 7 is an external perspective view of one of the cone cutters of FIG. 1.
Figure 8:
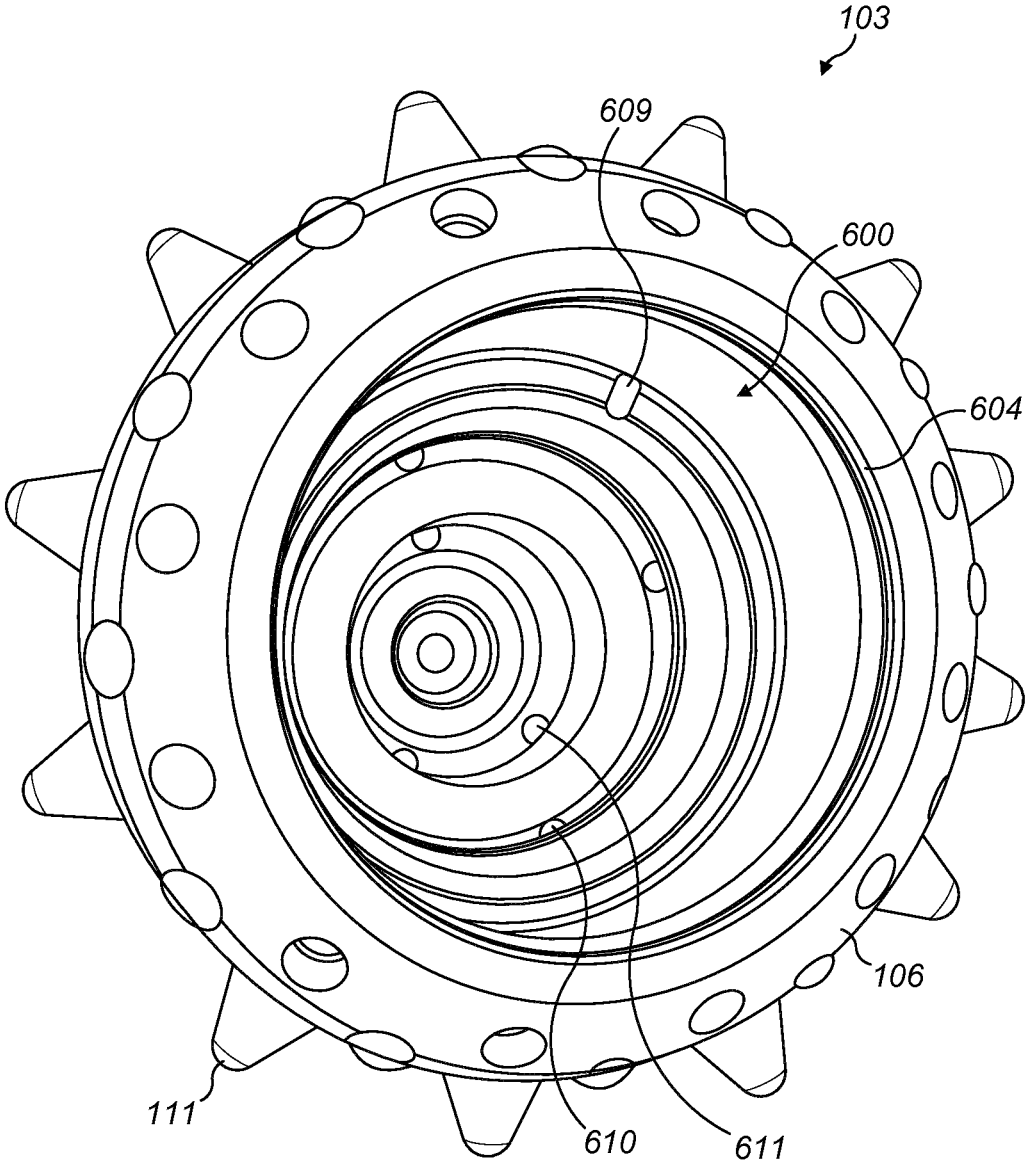
FIG. 8 is an underside perspective view of the cone cutter of FIG. 7 illustrating the cutter internal cavity.

Referring to FIGS. 6 to 8, the internal cavity 600 of cutter 103 may be divided into three axial sections relative to the cone longitudinal axis 613. A base section 601 extends inwardly from a cavity mouth 604 and is defined by an annular surface 618 aligned parallel to axis 613. Surface 618 is terminated by an annular end face 605 defined by a radially inward projecting annular first shoulder 606. An intermediate section 602 extends from base section 601 and is defined between first shoulder 606 and a radially inward projecting second annular shoulder 619. A corresponding curved annular region 607 is defined by second shoulder 619 and provides a terminal end of a concave surface 614 that defines intermediate section 602. Region 607 is terminated by the annular thrust bearing support surface 620 configured to be positioned in contact and to bear against snoochie surface 1002. An end or pilot section 603 extends from intermediate section 602 and is defined by annular surface 615 aligned substantially parallel to axis 613. Surface 615 is terminated by a concave or dome shaped surface 608 having an end or apex region 612 (that represents an end or innermost surface of cavity 600) that mounts the corresponding cutter thrust plug 212*b*.

Figure 9:
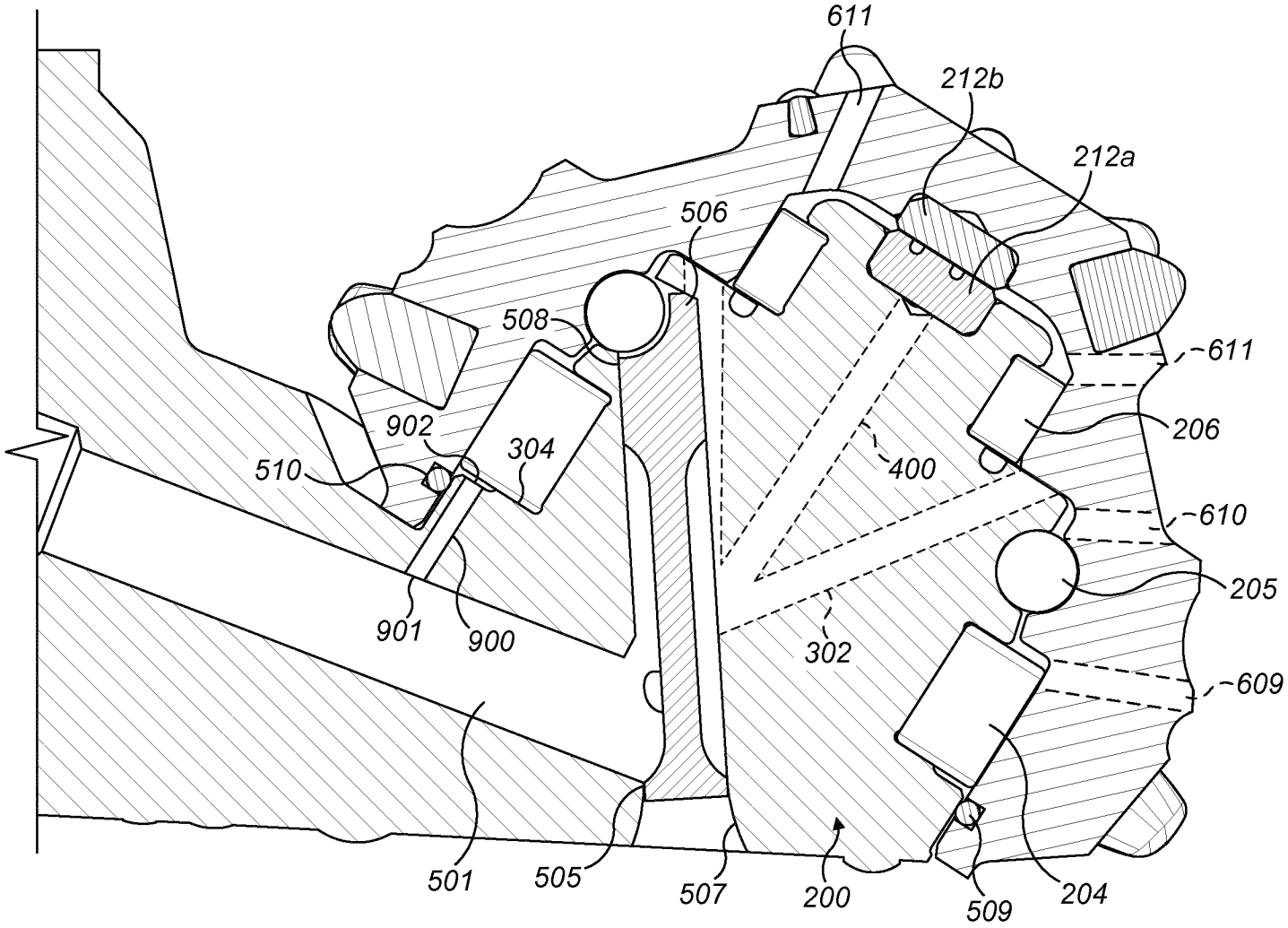
FIG. 9 is a further cross section through the cone cutter, spindle and journal leg of FIG. 1.

A plurality of vent holes are provided through the wall of cutter 103 and extend between the inward and outward facing surfaces 616, 617. In particular, one vent hole 609 extends radially outward from the region of first shoulder 606 substantially at a region of annular face 605 at base section 601. Four vent holes 610 project radially through the cutter wall being circumferentially spaced apart and extending generally from second shoulder 619 at surface 608 within intermediate section 602. Additionally, a third set of four vent holes 611 extend radially from cavity 600 at end section 603 corresponding to a position of domed end surface 608 at an axial end of annular surface 615. A combined cross sectional area of the nine vent holes 609, 610, 611 is approximately equal to or slightly less than a cross sectional area of supply passageway 501. Accordingly, this relative geometry and seal provided by O-ring 509 provides a positive pressure within cavity 600 when cutter 103 is mounted at spindle 200 and air is supplied through passageway 501, 301, 302 and 400, as disclosed in FIGS. 9 and 10.

Each journal leg 105 and spindle 200 also comprises a respective by-pass passageway 900 extending between supply passageway 501 and spindle base section 201. In particular, passageway 900 comprises a first end 901 in communication with supply passageway 501 and a second end 902 provided at bearing base surface 304. With cutter 103 mounted in position at spindle 200, by-pass passageway 900 is aligned substantially parallel to cutter axis 613 being transverse or perpendicular to supply passageway 501. Passageway end 902 emerges at a radially outer recessed section 1000 of bearing support surface 304 so as to be axially recessed from an end face 1001 of roller bearings 204. Additionally, the exit airflow end of by-pass passageway 900 is located inboard of seal 509 such that the air flow is directed inside of curter cavity 600. By-pass passageway 900 may be divided into a plurality of by-pass passageways 900 exiting at different respective regions of the bearing support surface 304. Additionally according to further specific implementations, the tool 100 may comprise a plurality of by-pass passageways 900 extending generally from the same location of the supply passageway 501 and exiting at the bearing support surface 304 at different radial and circumferentially spaced apart locations.

Referring to FIGS. 11 to 14, support surface 304 is divided radially into an inner surface 1101 and an outer surface 1100. Inner surface 1101 is slightly axially raised relative to outer surface 1100 so as to provide a support for a part of the end face of the larger roller bearings 204. According to the specific implementation, by-pass passageway 900 comprises a plurality of passageways exiting support surface 304 at different locations with all the by-pass passageways extending from supply passageway 501.

In particular, a first by-pass passageway 1102 extends from supply passageway 501 to exit at the inner surface 1101. A second by-pass passageway 1104 extends from supply passageway 501 to exit at outer surface 1100 being circumferentially spaced from first by-pass passageway 1102. A second and third by-pass passageway 1103*a* and 1103*b* are aligned parallel to one another and positioned side-by-side to extend from supply passageway 501 to exit at outer surface 1100 and being circumferentially spaced apart from second passageway 1104. Accordingly, three by-pass passageways 1103*a*, 1103*b* and 1104 exit spindle 200 at outer surface 1100 and a single by-pass passageway 1102 exits spindle 300 at inner surface 1101. Such a configuration is effective to provide a direct supply of air to the undersigned region of the roller bearings 204 and to provide an appropriate airflow stream for optimised delivery and circulation at the entire bearing assembly. The present by-pass passageway configuration is also advantageous, in certain embodiments, to provide a desired exhaust air flow at the base flange 208 of the spindle 200 at the junction with the leg 105. The present configuration of by-pass passageways 900 (1102 to 1104) may be implemented with an 'open' or 'semi-sealed' cutter configuration with and without seal 509, respectively. Where the cutter comprises seal 509, the by-pass passageways 900 may be configured to provide a relatively small exhaust flow or air from the base flange 208 at channel 305. The present arrangement is advantageous in that when implemented in a semi-sealed embodiment, following use (and wear of the cutter 103, and potentially seal 509) a greater volume of air will be allowed to exhaust at the base of spindle 200 at the region of flange 208. However, the majority of the exhaust airflow stream will flow through vent holes 609, 610 and 611 when implemented according to the semi-sealed embodiment of FIGS. 1 to 14.

Figure 15:
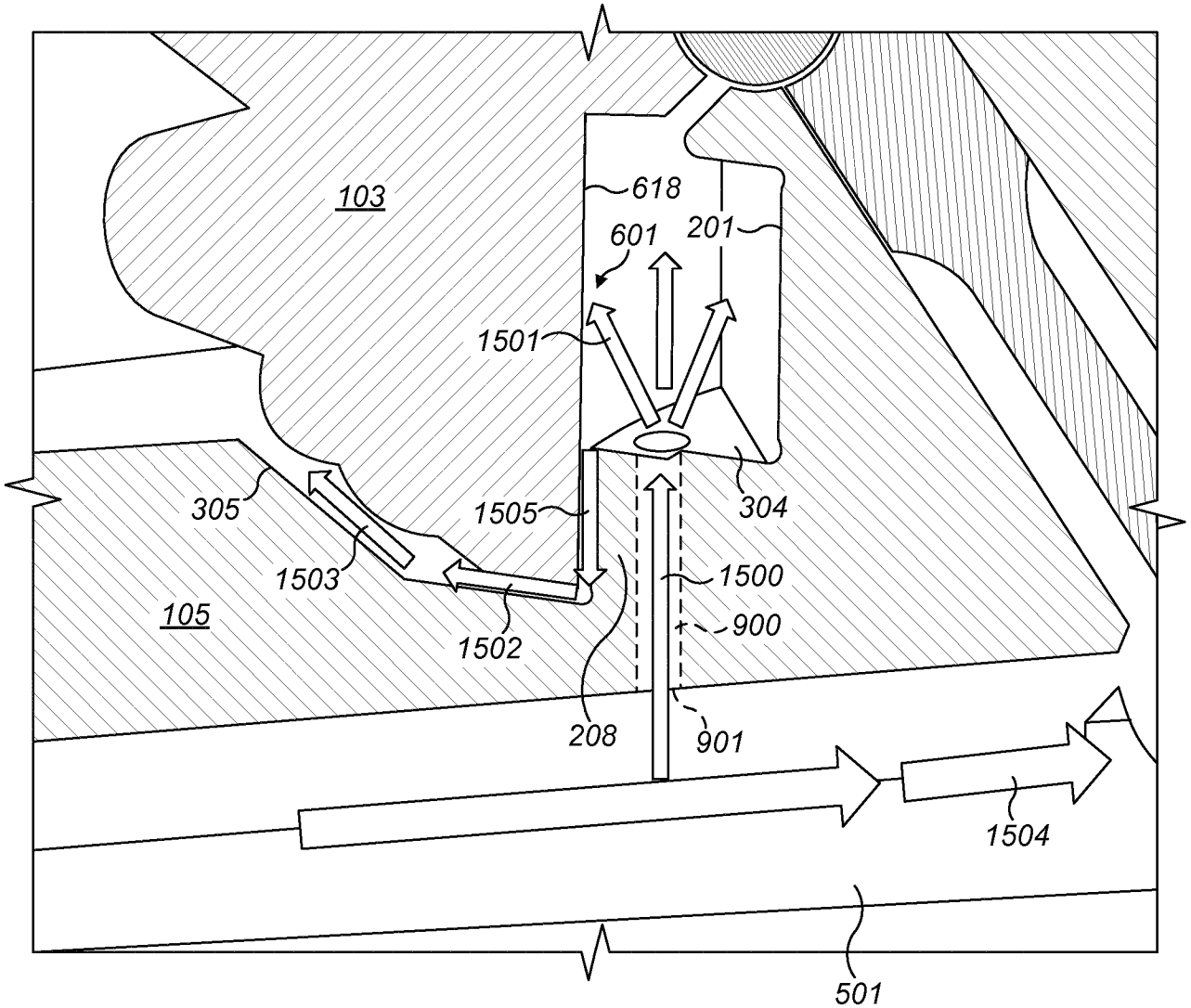
FIG. 15 is a magnified cross sectional view through the cone cutter, spindle and journal leg of FIG. 1 at a base region of the spindle and cutter.

FIG. 15 illustrates a further embodiment of the present by-pass passageway configuration implemented on an 'open' cutter arrangement without a base spindle seal 509. As with the semi-sealed arrangement by-pass passageway 900 is effective to divert a flow of air 1500 from the main airflow stream 1504 flowing through the passageway 501. The diverted airflow 1500 is supplied directly to the base region of the spindle at the larger roller bearings 204 as indicated schematically by arrows 1501 (roller bearings 204 are removed for illustrative purposes).

Specific to the 'open' cutter configuration, and where the cutter 103 does not comprise vent holes 609, 610 and 611, the airflow stream is directed to flow around the bearing assembly generally within cutter cavity 600 and to exit cavity 600 via stream 1505 flowing between the radially outward facing surface of spindle flange 208 and the radially inward facing surface 618 of cone cavity 600. The airflow 1502 then continues radially outward from flange 208 and within channel 305 to provide an exhaust airflow stream 1503 at channel 305. Such a configuration is effective to displace accumulated dirt and debris from around the cavity mouth 604 and to prevent ingress into the cavity 600 and in contact with bearings 204, 205 and 206 and spindle 200.

Airflow distribution passageways 302, 400 are beneficial to distribute the supply of air to the high load/friction snoochie surface region 1002 and the contact surfaces between the pilot thrust plugs 212*a*, 212*b*. Distribution passageways 302, 400 provide effective control of the distribution of airflow to all regions of the bearing assembly which in addition to by-pass passageway 900 serves to cool and clean the high friction contact surfaces between spindle 200, bearings 204, 205, 206 and parts of the cone internal surface 616 so that they do not overheat and wear prematurely.

Additionally, vent holes 609, 610, 611 are specifically positioned at the corner regions of the internal cavity 600 corresponding to the junctions between the three internal sections 601, 602, 603. The relative positioning and cross sectional area of vent holes 609, 610, 611 is effective to control the exhaust of the cleaning and cooling air supply from tool 100 so as to provide an optimised airflow path around the high load and friction components prior to exhaust. The respective location of the exit ends of vent holes 609, 610, 611 at the different axial sections of cone external surface 617 is effective to ensure cut rock and debris is constantly ejected from all parts of the external surface by the exhaust airflow.

The invention claimed is:

1. A rotary drill tool for cutting rock comprising:

a main body having an internal fluid supply passageway;

a spindle projecting from the main body and having a base region and at least one internal fluid distribution passageway in communication with the supply passageway and extending within the spindle and arranged to allow a fluid received from the supply passageway to flow therethrough and exit the spindle, wherein the spindle includes an annular shoulder and an end, the shoulder being positioned axially between the base region and the end, wherein the distribution passageway is divided into at least two separate distribution passageways, a first distribution passageway exiting the spindle substantially at the shoulder and a second distribution passageway exiting the spindle substantially at the end, wherein the shoulder is defined, in part, by an annular bearing surface, the first passageway exiting the spindle at the bearing surface;

a cone cutter rotatably mounted on the spindle via bearings, the cutter having an external region arranged to cut rock and a plurality of vent holes arranged to allow the fluid received from the distribution passageway to exit the tool as the cutter is rotated on the spindle, wherein the first distribution passageway is arranged to extend to and open at a face between the shoulder and the cutter and the first and second distribution passageways are arranged to deliver fluid to the face and the bearing surface, wherein the bearings include a first set of roller bearings mounted at or towards the base region, a second set of roller bearings mounted at or towards an end of the spindle, and a set of ball bearings mounted axially between the first and second set of roller bearings, wherein the first passageway exits the spindle axially between the set of ball bearings and the second set of roller bearings, the cutter having an internal cavity arranged to receive the spindle and the bearings, the cavity being defined axially by a base section arranged to accommodate the first set of roller bearings, an intermediate section arranged to accommodate the set of ball bearings and an end section arranged to accommodate the second set of roller bearings, the end section being terminated by a concave or domed shaped surface, wherein at least one vent hole extends through the cutter at a position closest to the base section and axially between the end section and the intermediate section, wherein a first vent hole of the plurality of vent holes extends through the cutter at a position closest to the end section and a second vent hole of the plurality of vent holes extends through the cutter at a position axially between the end and the intermediate section; and an annular seal positioned between the base region of the spindle and the cutter to restrict the fluid from exiting the tool at the base region, such that when fluid is constantly supplied to the internal fluid supply passageway, fluid is constantly exiting through all of the plurality of vent holes.

2. The tool as claimed in claim 1, wherein the first passageway is divided into two passageways exiting at different circumferential regions of the shoulder.

3. The tool as claimed in claim 1, wherein the shoulder is defined, in part, by an annular first bearing surface, the first passageway exiting the spindle at the first bearing surface.

4. The tool as claimed in claim 3, wherein at least part of the first bearing surface is aligned substantially perpendicular to a longitudinal axis of the spindle.

5. The tool as claimed in claim 4, wherein the end is defined, in part, by a second surface aligned substantially perpendicular to the axis of the spindle and the second distribution passageway exiting the spindle at the second surface.

6. The tool as claimed in claim 1, wherein a third vent hole of the plurality of vent holes extends through the cutter at a position closest to the base section.

7. The tool as claimed in claim 1, wherein the first distribution passageway exits at a recessed section indented into an annular grooved surface of the shoulder and the second distribution passageway exits at a recessed section at the end.

8. A rotary drill tool, for cutting rock comprising:

a main body having an internal fluid supply passageway;

a spindle projecting from the main body and having a base region and at least one internal fluid distribution passageway in communication with the supply passageway and extending within the spindle and arranged to allow a fluid received from the supply passageway to flow therethrough and exit the spindle, wherein the spindle includes an annular shoulder and an end, the shoulder being positioned axially between the base region and the end, wherein the distribution passageway is divided into at least two separate distribution passageways, a first distribution passageway exiting the spindle substantially at the shoulder and a second distribution passageway exiting the spindle substantially at the end, wherein the shoulder is defined, in part, by an annular bearing surface, the first passageway exiting the spindle at the bearing surface;

a cone cutter having a cutter axis and being rotatably mounted on the spindle via bearings, the cutter having an external region arranged to cut rock and at least one vent hole arranged to allow the fluid received from the distribution passageway to exit the tool as the cutter is rotated on the spindle, wherein the bearings include a first set of roller bearings mounted at or towards the base region, a second set of roller bearings mounted at or towards an end of the spindle, and a set of ball bearings mounted axially between the first and second set of roller bearings, wherein the first passageway exits the spindle axially between the set of ball bearings and the second set of roller bearings, wherein the at least one vent hole comprises three sets of vent holes, a first set positioned at or towards a base of the cutter, a third set positioned at or towards an apex of the cutter and a second set positioned axially between the first and third sets of vent holes; and an annular seal positioned between the base region of the spindle and the cutter to restrict the fluid from exiting the tool at the base region, such that when fluid is constantly supplied to the internal fluid supply passageway, fluid is constantly exiting through all of the plurality of vent holes.

9. The tool as claimed in claim 8, wherein the first set includes one to four vent holes and the second and third sets each include two to six vent holes.

10. The tool as claimed in claim 9, wherein the first set includes one vent hole and the second and third sets each include four vent holes.

11. The tool as claimed in claim 8, wherein the cutter includes an annular groove provided at an internal facing surface to at least partially accommodate the seal.

12. The tool as claimed in claim 11, wherein the spindle includes a cylindrical neck provided at a junction with the main body, wherein the seal is positioned radially between the groove and a radially outer surface of the neck.

13. The tool as claimed in claim 8, wherein a combined cross sectional area of the vent holes is substantially equal to or less than a cross sectional area of the supply passageway.

* * * * *